United States Patent [19]

Doerer

[11] 4,450,130

[45] May 22, 1984

[54] METHOD OF FIXTURING SHOE COMPONENT

[75] Inventor: Daniel M. Doerer, Chesterfield, Mo.

[73] Assignee: Brown Group, Inc., St. Louis, Mo.

[21] Appl. No.: 374,390

[22] Filed: May 3, 1982

[51] Int. Cl.[3] ..... B23C 5/00

[52] U.S. Cl. ..... 264/154; 29/423; 29/558; 29/559; 264/138; 264/219; 264/223

[58] Field of Search ..... 264/244, 219, 223, 225, 264/138, 154; 29/557, 558, 559, 423; 76/107 R

[56] References Cited

U.S. PATENT DOCUMENTS

| | | | |
|---|---|---|---|
| 2,565,758 | 8/1951 | Covino | 264/223 |
| 3,337,945 | 8/1967 | Mooney | 29/423 |
| 4,104,347 | 8/1978 | Ohashi et al. | 264/219 X |
| 4,179,484 | 12/1979 | Neefe | 264/219 X |

*Primary Examiner*—Donald E. Czaja

*Assistant Examiner*—James C. Housel

*Attorney, Agent, or Firm*—Gravely, Lieder & Woodruff

[57] ABSTRACT

A method of fixturing a shoe component from a block of suitable material by forming a first cavity in the block to expose a first surface of the component, applying a release agent to the first surface of the component, placing a body of a rigid material in the first cavity so as to extend over the entire first surface and into the surfaces of the block for adherence thereof to the block of material, repositioning the block, forming a cavity in the repositioned block to initiate the shaping of the shoe component, attaching the shoe component in its unfinished state to the body of rigid material, continuing the formation of the shoe component to completion to free it from connection with the block of material, and releasing the thus completed shoe component from the body of rigid material.

5 Claims, 9 Drawing Figures

METHOD OF FIXTURING SHOE COMPONENT

BACKGROUND OF THE INVENTION

1. Field of the Invention

This invention pertains to a method of fixturing a shoe component such as a unit sole or a shoe last as it is cut by a numerically controlled milling apparatus.

2. Description of the Prior Art

The prior art is principally directed to the forming of lasts or components for shoe making by the well known fabricating of the last or component from a block of wood through modelling methods which produce individual lasts or component. In the well known methods of producing lasts or components it is common practice to start with the block of material such as wood and to hold it in a clamp, vice, or in hand during the last or component forming operation which cuts the block down to the shape desired. If, in the forming of the last or the component it becomes necessary to clamp the block, that may result in damage to the surface. It has been found that fixturing or clamping on an irregular or contoured surface might require as much time and skill as the actual cutting for producing the component, and it is this problem that the present invention seeks to avoid.

In some instances, lasts are made by casting the foot of a particular individual, shaping the cast to the form of a last and utilizing the cast as a last or as the model to produce a wood last with the aid of the usual last-making machinery. Such a procedure is disclosed in MacDonald U.S. Pat. No. 2,002,580 of May 28, 1935, and an example of last-making machinery is disclosed in Foster U.S. Pat. No. 1,269,273 of June 11, 1918.

SUMMARY OF THE INVENTION

The present method of fixturing is directed to the formation of a unit sole or a shoe last or component as it is milled from a block without the need for cutting any unsupported areas, thereby avoiding chipping the part. It is also directed to fixturing without the need for clamping the component directly, and also shortening set up time by minimizing the number of orientations.

The objects of this invention are to provide a method for making either a unit sole for a shoe or a complete last or component for a shoe by a series of steps in which the component desired is milled from a block of wood in a series of steps which does not call for allowing the component to be unsupported in any areas during the cutting operation, in which the block is held so the component itself does not have to be clamped, and in which set up time is minimized.

The preferred method involves milling a cavity in a block and in the milling simultaneously forming a first surface of the component having the least surface area after cutting, which first surface area can receive a release agent, followed by applying a body of rigid polyurethane to the first surface and to the cavity so the rigid body of polyurethane will adhere to the block cavity, followed by milling the second surface of the component to a sufficient extent that the component can be releasibly attached to the rigid body, followed by completing the milling of the subsequent surfaces which are then followed by releasing the attachments to free the component from the starting block of material.

BRIEF DESCRIPTION OF THE DRAWINGS

The present method is illustrated in a preferred sequence of steps by the following drawing views, wherein.

DETAILED DESCRIPTION OF THE INVENTION

The several drawing views illustrate the principal stages in the present method of fixturing a shoe component, which in the case selected is a component formed from a starting block of wood selected from mahogany, beach, maple, or pine. If the component is to be a unit sole it may be milled from a block of a suitable plastic material. The method applies equally well when the starting block is wood or plastic.

Figure 1:
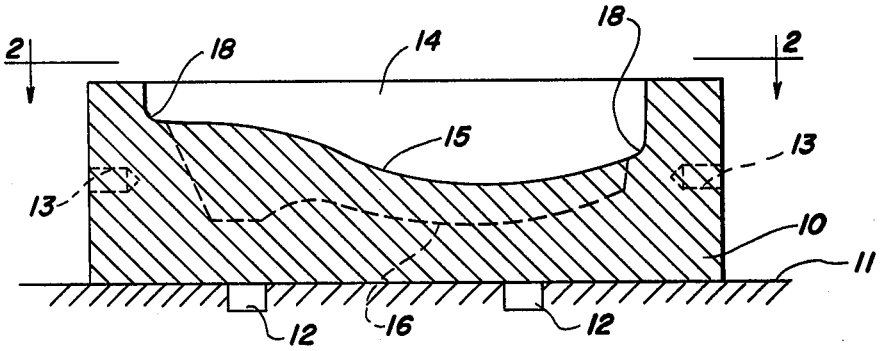
FIG. 1 is a longitudinal sectional elevation of a block of starting material showing the milled out cavity which results in the forming of a first surface of the components.
Figure 2:
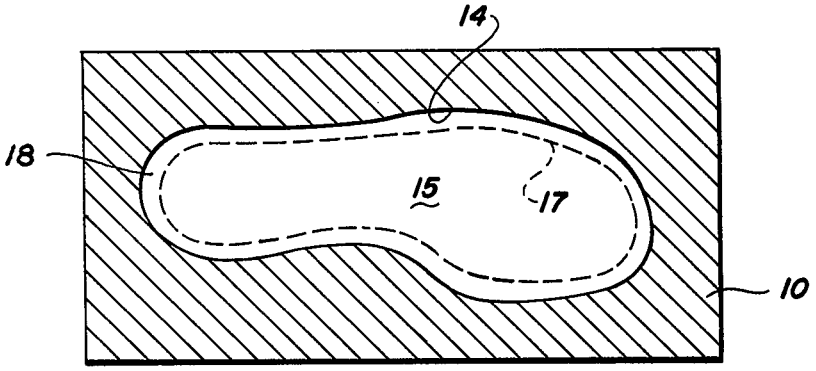
FIG. 2 is a view taken along line 2—2 in FIG. 1 to further show in dotted outline the surface area of the component to be treated with a release agent.

Referring now to FIGS. 1 and 2, the starting block 10 is placed on a suitable supporting surface 11 which has preformed recesses 12 for a purpose to appear. The block is provided with sockets 13 which serve as hold downs before and after rotating the block 10 180° at the appropriate time during the process. The block 10 is milled out to form a first cavity 14 in which the bottom surface 15 is a surface of the eventual component whose complete outline is indicated by the dash line 16. The surface 15 presents the least area to the cavity 14, and in FIG. 2 it can be seen that the area 15 is indicated by the dash line 17 so that the area of the cavity 14 outside the dash line 17 is a surface 18 of the cavity in the block 10.

Figure 3:
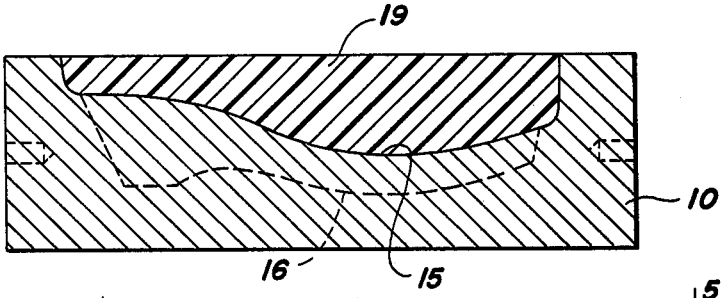
FIG. 3 is a longitudinal sectional elevation of the starting block cavity filled with a rigid polyurethane material.
Figure 4:
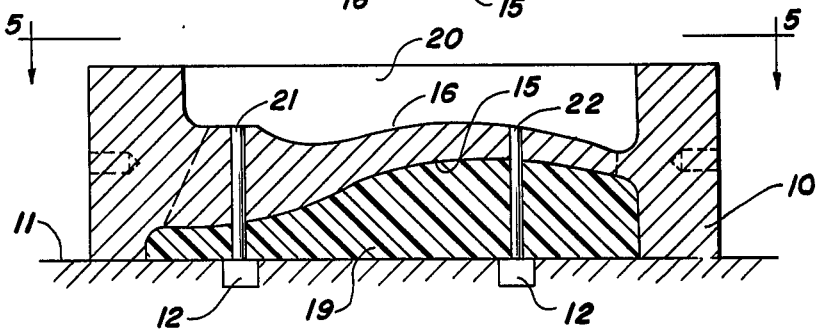
FIG. 4 is a further longitudinal sectional view of the block of starting material rotated to present the opposite surface upwardly so a partial formation of a second surface of the component can be milled, and holes located for the insertion of attachment elements.

The surface area 15 of FIG. 2 is covered with a suitable release agent which may be a sealant such as a film of lacquer applied directly to the surface area 15 and then covered with a petroleum base material which constitutes the release agent. After the release agent has been applied, the cavity 14 is filled with a body 19 (FIG. 3) of a microcellular rigid polyurethane which will firmly adhere to the surface 18 but will not adhere to the area covered with the release agent. The polyurethane has low density, fast creaming and fast curing characteristics so the block 10 can, with little lost time be rotated about the axis of the sockets 13 to the position of FIG. 4.

Figure 5:
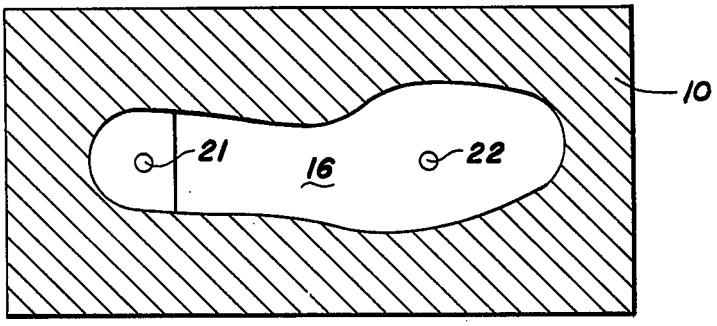
FIG. 5 is a view taken along line 5—5 in FIG. 4.
Figure 6:
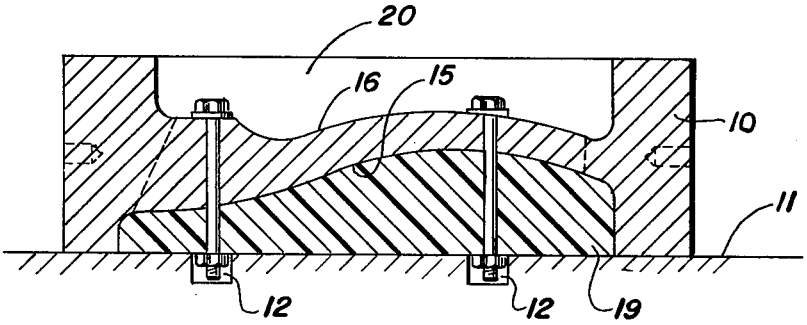
FIG. 6 is a view similar to FIG. 4 with the attachment elements in place.
Figure 7:
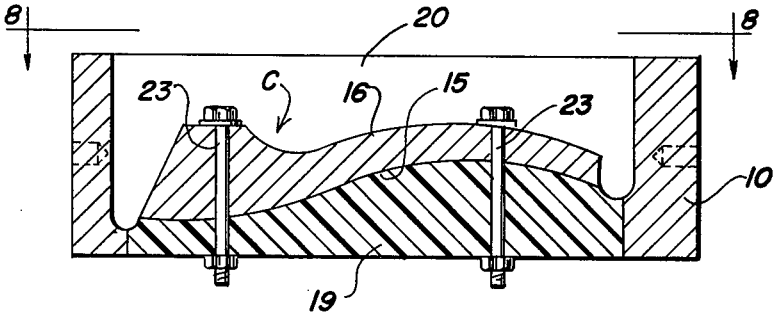
FIG. 7 is a view similar to FIG. 4 with the milled second surface of the component cut to the finished contour.
Figure 8:
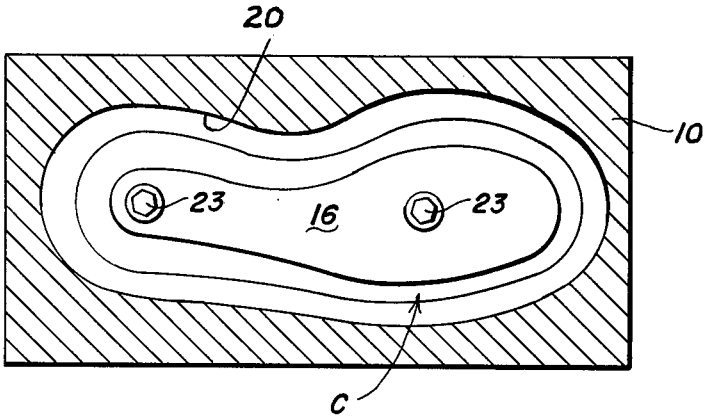
FIG. 8 is a view taken along line 8—8 in FIG. 7.
Figure 9:
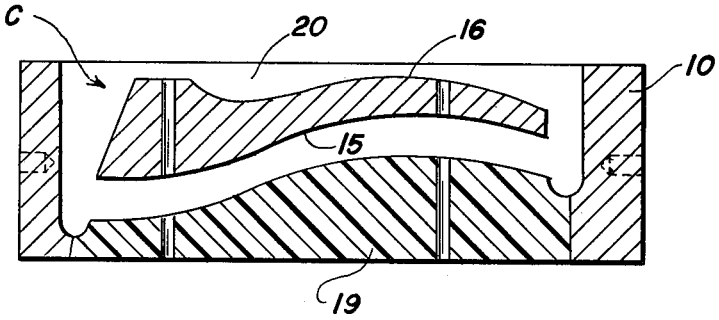
FIG. 9 is a view similar to FIG. 7 showing the release of the finished component from the rigid polyurethane material.

The next stage in the method (FIGS. 4, 5 and 6) is to mill a second cavity 20 in the block 10 so as to form the surface 16 of the component. At this stage holes 21 and 22 are drilled through the component and the polyurethane body 19 in alignment with the recesses 12 in the support 11, and attachment bolts 23 are installed to hold the component on the polyurethane body 19. Once the bolts 23 are in place, the cavity 20 can be completely milled out as shown in FIGS. 7 and 8 so that the finished component C is freed from the starting block 10, but is held by the bolts 23. The method is completed by removing the bolts 23 so the component C can be removed. The block 10 with its adhered polyurethane body is normally disposed of as its usefulness is over. The release agent allows the component C to readily detach from the polyurethane, but the latter remains firmly attached to the block 10 and provides the necessary support for the component during all milling cutting operations.

The foregoing disclosure has related to a preferred embodiment, however, modifications may come to mind after the present invention has been understood, and all such modifications are intended to be included within the scope of the invention.

What is claimed is:

1. A method for fixturing a shoe component while cutting the component from a starting block of rigid machinable material while supported on a work surface, said method comprising:

(a) cutting a first cavity in one side of the starting block to shape a first surface of the shoe component with the cutting of the first cavity being greater than the shape of the first surface to provide a marginal surface peripheral to the shape of the first surface;

(b) applying a mold release agent to only the first surface of the shoe component;

(c) filling the cavity in the starting block with a rigid material capable of adhering to the marginal surface peripheral to the shape of the first surface in the cavity but not to the surface of the shoe component to which the mold release agent is applied;

(d) cutting a second cavity in the side of the starting block opposite to said first cavity to partially shape a further surface of the shoe component with an exposed marginal surface surrounding the further surface;

(e) establishing a temporary attachment between the rigid machinable material and the shoe component for supporting that component;

(f) completing the shoe component by further cutting into the starting block in the second cavity to remove the starting block material between the first and the further surface of the shoe component such that a peripheral surface of the shoe component is cut to match the first surface and the further surface; and (g) removing the temporary attachment to release the shoe component from the rigid machinable material and the filling material.

2. The method set forth in claim 1 wherein the starting block of rigid machinable material is rotated 130° after cutting the first cavity to position the starting block for cutting the second cavity.

3. The method set forth in claim 1 wherein the rigid machinable material constitutes the fixturing support for the shoe component.

4. A method of fixturing a unit sole while cutting it out of a block of rigid machinable material supported on a work surface, the method comprising:

(a) cutting a first cavity in the starting block of material to a size greater than the area of the unit sole;

(b) applying a mold release agent to the surface area of the unit sole;

(c) pouring a rigid-when-cured liquid support polyurethane material into the first cavity, which support material adheres to the exposed surfaces of the starting block of material outside the surface area of the unit sole;

(d) cutting a second cavity in the opposite side of the starting block of material from the first cavity to expose a surface area greater than a partial surface of the bottom of the unit sole;

(e) temporarily securing the unit sole directly to the rigid-when-cured support material poured into the first cavity;

(f) continuing to cut the second cavity after temporarily securing the unit sole to expose the remainder of the surfaces of the bottom of the unit sole beyond the exposed partial surface of the unit sole; and (g) releasing the unit sole from its temporary securement on the rigid-when-cured support material.

5. A method of fixturing a shoe component while cutting it from a block of rigid machinable material, comprising the steps of:

(a) mounting the block so it can be clamped in a stationary starting position and released so it can be rotated at least 180°;

(b) cutting into the block from one side to shape a first surface which includes a shoe unit sole area therein;

(c) applying a mold release agent on just the surface of the shoe unit sole area;

(d) applying a body of rigid polyurethane on the mold release agent and the adjacent cut surfaces of the block;

(e) unclamping and rotating the block 180° to present a second side for cutting;

(f) cutting into the second side of the block to shape a second surface of the shoe component which with the first surface is in the shape of a partially completed shoe component;

(g) temporarily securing the partially completed shoe component to the body of rigid polyurethane;

(h) extending the cutting into the second side of the block to complete the exposing and shaping of the shoe component;

(i) and releasing the completed shoe component from the body of rigid polyurethane by which it is temporarily secured.

* * * * *